United States Patent [19]

Harltine, III

[11] 3,936,297

[45] Feb. 3, 1976

[54] METHOD OF PRODUCING AUSTENITIC STAINLESS STEEL

[75] Inventor: Albert G. Harltine, III, Tarentum, Pa.

[73] Assignee: Allegheny Ludlum Industries, Inc., Pittsburgh, Pa.

[22] Filed: Jan. 4, 1974

[21] Appl. No.: 430,853

Related U.S. Application Data

[62] Division of Ser. No. 251,637, May 8, 1972, Pat. No. 3,820,980.

[52] U.S. Cl. ..... 75/130.5; 75/122; 75/126 B; 75/126 J

[51] Int. Cl.² ..... C22C 38/38

[58] Field of Search ..... 75/122, 126 B, 126 J, 130.5

[56] References Cited

UNITED STATES PATENTS

| | | | |
|---|---|---|---|
| 2,069,205 | 2/1973 | Arness | 75/130.5 |
| 2,537,103 | 1/1951 | Tanczyn | 75/130.5 X |
| 2,696,433 | 12/1954 | Tanczyn | 75/130.5 |
| 2,778,731 | 1/1957 | Carney | 75/126 B |

FOREIGN PATENTS OR APPLICATIONS

| | | | |
|---|---|---|---|
| 778,597 | 2/1956 | United Kingdom | 75/126 R |

*Primary Examiner*—L. Dewayne Rutledge
*Assistant Examiner*—Arthur J. Steiner
*Attorney, Agent, or Firm*—Vincent G. Gioia; Robert F. Dropkin

[57] ABSTRACT

A substantially nonporous, austenitic stainless steel, and a method for producing it; consisting essentially of, in weight percent, from 10 to 30% chromium, from 15 to 45% manganese, from 0.85 to 3% nitrogen, up to 1% carbon, up to 2% silicon, balance essentially iron and residuals. Moreover, a steel wherein said elements are balanced in accordance with the following equations:

$$\frac{30\,(\%C+\%N)+0.5\,(\%Mn)}{\%Cr+1.5\,(\%Si)} \geqq 1.5$$

$$\%Cr + 0.8\,(\%Mn) - 11.88\,(\%N - 0.1) - 28.25 \geqq 0$$

9 Claims, No Drawings

METHOD OF PRODUCING AUSTENITIC STAINLESS STEEL

This is a division of application Ser. No. 251,637, filed May 8, 1972, now U.S. Pat. No. 3,820,980.

The present invention relates to a nonporous, high nitrogen-chromium-manganese, austenitic stainless steel, and to a method for producing it.

Today, stainless steels are available in a variety of structures exhibiting a range of mechanical properties which, combined with their excellent corrosion resistance, makes them highly versatile from a design standpoint. Of them, austenitic stainless steels generally possess the best corrosion resistance and the best strength at elevated temperatures. Austenitic stainless steels have generally been comprised of iron, chromium and nickel.

Shortages of nickel, one of the primary constituents of austenitic stainless steels, have caused considerable concern during critical times in history, and have resulted in it becoming a costly element. Out of the concern and high cost, arose extensive investigations aimed at providing austenitic steels having part or all of their nickel replaced by other elements. At the present time, the two preferred substitutions are manganese and nitrogen. The use of manganese and/or nitrogen does, however, have its drawbacks. Manganese is only half as powerful an austenitizer as is nickel and nitrogen has a tendency to produce a porous ingot.

Through the present invention, there is provided a high nitrogen-chromium-manganese, austenitic stainless steel characterized by high strength, good corrosion resistance and excellent ductility in the annealed condition. Moreover, an austenitic steel wherein the elements are carefully balanced to insure the integrity of its austenitic structure and wherein sufficient chromium and manganese are present to provide a nonporous structure. The steel contains from 0.85 to 3% nitrogen, from 10 to 30% chromium and from 15 to 45% manganese. At first glance it appears to be somewhat similar to the steels disclosed in U.S. Pat. Nos. 2,778,731 and 2,745,740. However, the steel of Pat. No. 2,778,731 has a maximum equated chromium and manganese content below the minimum equated sum of chromium and manganese imposed upon the steel of the present invention and U.S. Pat. No. 2,745,740 does not disclose a composition balanced within the hereinbelow discussed austeniticity and porosity equation limitations imposed upon the present invention, as exemplified by the specific alloys therein. Still other references disclose relatively high nitrogen contents, but yet maximum contents below the minimum taught herein. These references are U.S. Pat. No. 2,909,425 and an article entitled *Study of Austenitic Stainless Steels With High Manganese and Nitrogen Contents*, which appeared on pages 399–412 of *Revue de Metallurgie*, No. 5, May 1970.

It is accordingly an object of this invention to provide a nonporous high nitrogen-chromium-manganese, austenitic stainless steel.

It is a further object of this invention to provide a method for producing a nonporous, high nitrogen-chromium-manganese, austenitic stainless steel.

The nonporous, austenitic stainless steel of the present invention has a composition consisting essentially of, in weight percent, from 10 to 30% chromium, from 15 to 45% manganese, from 0.85 to 3% nitrogen, up to 1% carbon, up to 2% silicon, balance essentially iron and residuals. In addition, its elements are balanced in accordance with the following equations.

$$\frac{30\,(\%C + \%N) + 0.5\,(\%Mn)}{\%Cr + 1.5\,(\%Si)} \geqq 1.5 \qquad (1)$$

$$\%Cr + 0.8\,(\%Mn) - 11.88\,(\%N - 0.1) - 28.25 \geqq 0 \qquad (2)$$

Equation 1 is a measure of the steels austeniticity and equation 2 is an indicator of its porosity or lack thereof. Steels which do not satisfy the equations are outside the scope of the invention. As a general rule, the steel of the invention is melted at an ambient pressure of about one atmosphere, and this method of making it is incorporated as a part of the present invention. The particular form in which nitrogen is added is not critical. Illustrative forms includes activated nitrogen, cyanides, and high nitrogen ferro-chrome.

Nitrogen, a strong austenitizer, is present in amounts of from 0.85 to 3%. At least 0.85% is required as it is the steel's primary strengthening element. An upper limit of 3% is imposed as higher nitrogen contents appear to be unrealistic from a melting standpoint. A preferred nitrogen content is from 1.05 to 1.5%.

Chromium is present in amounts of from 10 to 30%. At least 10% is required in order to give the steel its outstanding corrosion resistance. Chromium also has a secondary effect upon the strength of the steel and is a primary element in increasing the steel's solubility for nitrogen. An upper limit of 30% is imposed as chromium is a ferrite former and excessive amounts of ferrite might form with higher levels, and in turn degrade the steel's properties. A preferred chromium content is from 15 to 27%. Steels with chromium contents below 15% and above 27% are difficult to process. Those with contents below 15% exhibit a greater tendency to hot short while those with contents in excess of 27% exhibit a greater tendency to crack during handling and forming.

Manganese is present in amounts of from 15 to 45%. At least 15%, and preferably 21% is necessary as manganese is an austenitizer and since manganese increases the steel's solubility for nitrogen. An upper limit of 45%, and a preferred upper limit of 30%, is imposed for economic considerations, and since manganese exhibits a tendency to attack furnace refractories.

Carbon is a powerful austenitizer and strengthener and is present in amounts up to 1%. Its content must, however, be controlled as it can disadvantageously remove chromium from solid solution by combining therewith to form chromium carbides, and since it can reduce the steel's solubility for nitrogen by occupying interstitial sites normally filled by nitrogen. A preferred maximum carbon content is 0.15%. Higher carbon contents necessitate higher annealing temperatures to put the carbon into solution.

Silicon levels are maintained below 2% and preferably below 1%. Higher levels increase the inclusion content of the steel to an undesirable degree, and moreover, tie up excessive amounts of manganese in the form of manganese silicates.

As stated above, the steel may also contain a number of residuals. These residuals include elements such as copper, molybdenum, phosphorus, sulfur, tungsten, cobalt and nickel.

The following examples, are illustrative of the invention.

Thirty steel heats having chromium contents from 10.0 to 40.49%, manganese contents from 9.94 to 30.1%, nitrogen contents from 0.92 to 1.95%, carbon contents from 0.015 to 0.118% and silicon contents from 0.19 to 0.55% were melted at an ambient pressure of about one atmosphere. Their chemistry appears hereinbelow in Table I.

The heats were prepared by introducing solid materials in the proportions required to provide the desired amount of chromium, manganese, carbon, silicon, and iron into the furnace which was maintained at atmospheric pressure. These materials were melted, after which nitrogen was introduced into the melt at atmospheric pressure. The composition of the melt is such that the desired amount of nitrogen, up to 3%w, is taken into the melt at atmospheric pressure.

TABLE I

| | CHEMISTRY | | | | | | | | | |
|---|---|---|---|---|---|---|---|---|---|---|
| HEAT | C | Mn | P | S | Si | Cr | Ni | Mo | Cu | N |
| A. | 0.069 | 21.40 | 0.007 | 0.010 | 0.19 | 24.16 | 0.27 | 0.025 | 0.10 | 1.06 |
| B. | 0.062 | 25.60 | 0.012 | 0.011 | 0.23 | 25.26 | 0.26 | 0.026 | 0.12 | 1.30 |
| C. | 0.118 | 23.60 | 0.007 | 0.010 | 0.41 | 23.25 | 0.27 | 0.020 | 0.10 | 1.05 |
| D. | 0.068 | 21.50 | 0.006 | 0.011 | 0.51 | 23.22 | 0.25 | 0.025 | 0.24 | 1.11 |
| E. | 0.084 | 23.62 | 0.008 | 0.013 | 0.44 | 22.98 | 0.25 | 0.020 | 0.23 | 1.20 |
| F. | 0.100 | 21.62 | 0.009 | 0.012 | 0.46 | 24.90 | 0.25 | 0.020 | 0.23 | 1.26 |
| G. | 0.086 | 26.00 | 0.013 | 0.013 | 0.55 | 25.76 | 0.25 | 0.026 | 0.23 | 1.58 |
| H. | 0.033 | 21.40 | 0.009 | 0.010 | 0.52 | 23.26 | 0.32 | 0.010 | 0.24 | 1.45 |
| I. | 0.10 | 21.00 | L | L | 0.50 | 25.00 | 0.20 | 0.010 | 0.20 | 1.55 |
| J. | 0.031 | 21.80 | 0.006 | 0.008 | 0.49 | 24.54 | 0.27 | 0.024 | 0.25 | 1.16 |
| K. | 0.10 | 25.00 | L | L | 0.50 | 25.00 | 0.20 | 0.010 | 0.20 | 1.95 |
| L. | 0.020 | 25.25 | 0.012 | 0.009 | 0.51 | 24.98 | 0.32 | 0.025 | 0.20 | 1.20 |
| M. | 0.023 | 25.75 | 0.016 | 0.006 | 0.40 | 29.64 | 0.25 | NA | 0.19 | 1.03 |
| N. | 0.032 | 10.60 | 0.008 | 0.011 | 0.50 | 30.10 | 0.22 | NA | 0.21 | 1.04 |
| O. | 0.029 | 16.00 | 0.008 | 0.011 | 0.42 | 25.08 | 0.22 | NA | 0.19 | 1.04 |
| P. | 0.05 | 10.00 | L | L | 0.50 | 25.00 | 0.20 | NA | 0.20 | 1.05 |
| Q. | 0.032 | 25.56 | 0.013 | 0.010 | 0.42 | 29.82 | 0.28 | NA | 0.24 | 1.20 |
| R. | 0.054 | 24.50 | 0.010 | 0.009 | 0.39 | 19.84 | 0.26 | NA | 0.18 | 1.00 |
| S. | 0.049 | 20.30 | 0.010 | 0.009 | 0.37 | 20.06 | 0.26 | NA | 0.19 | 1.00 |
| T. | 0.05 | 25.00 | L | L | 0.40 | 15.00 | 0.20 | NA | 0.20 | 1.05 |
| U. | 0.05 | 30.00 | L | L | 0.40 | 10.00 | 0.20 | NA | 0.20 | 1.05 |
| V. | 0.022 | 10.32 | 0.012 | 0.009 | 0.41 | 35.22 | 0.21 | NA | 0.12 | 1.05 |
| W. | 0.028 | 16.65 | 0.011 | 0.010 | 0.38 | 30.29 | 0.20 | NA | 0.12 | 1.05 |
| X. | 0.025 | 29.99 | 0.007 | 0.010 | 0.34 | 15.02 | 0.22 | NA | 0.15 | 1.10 |
| Y. | 0.019 | 29.84 | 0.008 | 0.006 | 0.51 | 40.34 | 0.29 | NA | 0.18 | 0.97 |
| Z. | 0.016 | 30.10 | 0.015 | 0.001 | 0.28 | 35.51 | 0.28 | NA | 0.20 | 0.96 |
| AA. | 0.015 | 19.62 | 0.014 | 0.001 | 0.45 | 35.55 | 0.29 | NA | 0.18 | 0.93 |
| BB. | 0.015 | 19.61 | 0.016 | 0.001 | 0.44 | 39.79 | 0.29 | NA | 0.20 | 0.98 |
| CC. | 0.018 | 9.94 | 0.015 | 0.004 | 0.52 | 40.49 | 0.31 | NA | 0.18 | 1.02 |
| DD. | 0.017 | 9.98 | 0.013 | 0.003 | 0.52 | 35.08 | 0.27 | NA | 0.20 | 0.92 |

L - Low concentration requested

NA - Analysis not performed

The structure of each heat was examined. Those having chromium contents of 35% and more were tapped at 2650°F, sectioned and optically examined at magnifications up to 1000 X. All of them had duplex structures (austenite and ferrite), as shown in Table II hereinbelow. Those remaining heats which were porous could be detected by the naked eye. They were sectioned and classified porous if they had voids in excess of ⅛ inch. Table II also shows which heats were porous. The remaining heats were ground to remove casting defects, hot processed, cold processed and examined. Hot processing involved a preheat of 1500°– 1700°F for 1 – 2 hours, a heating at 2200°– 2350°F for 2 – 3 hours, and a rolling or forging at a minimum temperature of 1700°– 1800°F. Cold processing involved an anneal at 1900°– 2000°F for 120 minutes per inch of thickness, an air cool, at least one cold roll adding up to a reduction of up to 80%, an anneal at 1950° F and an air cool. The examination involved optical observations at magnifications up to 500X and transmission electronmicroscopy observations at magnifications up to 50,000X. The results of this examination are reproduced in Table II.

TABLE II

| HEAT | STRUCTURE |
|---|---|
| A. | AUSTENITIC |
| B. | AUSTENITIC |
| C. | AUSTENITIC |
| D. | AUSTENITIC |
| E. | AUSTENITIC |
| F. | AUSTENITIC |
| G. | AUSTENITIC |
| H. | POROUS |
| I. | POROUS |
| J. | AUSTENITIC |
| K. | POROUS |
| L. | AUSTENITIC |
| M. | AUSTENITIC |
| N. | POROUS |
| O. | POROUS |
| P. | POROUS |
| Q. | AUSTENITIC |
| R. | AUSTENITIC |
| S. | POROUS |
| T. | POROUS |
| U. | POROUS |
| V. | AUSTENITE & FERRITE |
| W. | AUSTENITE & FERRITE |
| X. | POROUS |
| Y. | AUSTENITE & FERRITE |
| Z. | AUSTENITE & FERRITE |
| AA. | AUSTENITE & FERRITE |
| BB. | AUSTENITE & FERRITE |
| CC. | AUSTENITE & FERRITE |
| DD. | AUSTENITE & FERRITE |

From Table II, it is noted that heats A through G, J, L, M, Q and R had austenitic structures, that heats H, I, K, N through P, S through U, and X, had porous structures, and that heats V, W, and Y through DD had duplex structures of austenite and ferrite.

The carbon, nitrogen, manganese, chromium and silicon values for both the austenitic and duplex heats were inserted into the following equation, discussed hereinabove and referred to as equation 1 therein:

$$\frac{30\,(\%C + \%N) + 0.5\,(\%Mn)}{\%Cr + 1.5\,(\%Si)}$$

The calculated ratios for each of the heats is set forth below in Table III.

TABLE III

| HEAT | STRUCTURE | CALCULATED VALUE |
|---|---|---|
| A. | AUSTENITIC | 1.78 |
| B. | AUSTENITIC | 2.14 |
| C. | AUSTENITIC | 2.0 |
| D. | AUSTENITIC | 1.95 |
| E. | AUSTENITIC | 2.14 |
| F. | AUSTENITIC | 2.06 |
| G. | AUSTENITIC | 2.40 |
| J. | AUSTENITIC | 1.86 |
| L. | AUSTENITIC | 1.88 |
| M. | AUSTENITIC | 1.52 |
| Q. | AUSTENITIC | 1.61 |
| R. | AUSTENITIC | 2.22 |
| V. | AUSTENITE & FERRITE | 1.07 |
| W. | AUSTENITE & FERRITE | 1.34 |
| Y. | AUSTENITE & FERRITE | 1.09 |
| Z. | AUSTENITE & FERRITE | 1.26 |
| AA. | AUSTENITE & FERRITE | 1.01 |
| BB. | AUSTENITE & FERRITE | 0.98 |
| CC. | AUSTENITE & FERRITE | 0.85 |
| DD. | AUSTENITE & FERRITE | 0.89 |

From Table III it is clear that all the austenitic heats have calculated ratios in excess of 1.5, a limitation imposed upon the steel of the present invention, and that all the duplex heats (austenite & ferrite) have calculated ratios below 1.5. The lowest ratio for any of the austenitic heats is 1.52 whereas the highest ratio for any of the duplex heats is 1.34.

The chromium, manganese and nitrogen contents for both the austenitic and porous heats were inserted into the following equation, discussed hereinabove and referred to as equation 2 therein:

$$\%\,Cr + 0.8\,(\%\,Mn) - 11.88\,(\%\,N - 0.1) - 28.25 \geqq 0$$

The calculated value for each of the heats is set forth below in Table IV.

TABLE IV

| HEAT | STRUCTURE | CALCULATED VALUE |
|---|---|---|
| A. | AUSTENITIC | 1.65 |
| B. | AUSTENITIC | 3.35 |
| C. | AUSTENITIC | 2.65 |
| D. | AUSTENITIC | 0.15 |
| E. | AUSTENITIC | 0.55 |
| F. | AUSTENITIC | 0.15 |
| G. | AUSTENITIC | 0.75 |
| J. | AUSTENITIC | 1.05 |
| L. | AUSTENITIC | 3.85 |
| M. | AUSTENITIC | 10.94 |
| Q. | AUSTENITIC | 8.95 |
| R. | AUSTENITIC | 0.45 |
| H. | POROUS | −3.85 |
| I. | POROUS | −3.65 |
| K. | POROUS | −5.25 |
| N. | POROUS | −0.75 |
| O | POROUS | −1.55 |
| P. | POROUS | −6.55 |
| S. | POROUS | −2.65 |
| T. | POROUS | −4.55 |
| U. | POROUS | −5.55 |
| X. | POROUS | −1.11 |

From Table IV it is clear that all the austenitic heats have calculated values in excess of 0, a limitation imposed upon the steel of the present invention, and that all the porous heats have calculated values below 0. The lowest value for any of the austenitic heats is 0.15 whereas the highest (least negative) value for any of the porous heats is − 0.75.

As stated above, the properties of the steel of this invention are dependent upon the attainment of an austenitic structure. To demonstrate this, the properties of austenitic heat J are compared to those of duplex heat V, in Table V hereinbelow. No comparison is made between the properties of a porous heat and those of an austenitic heat as porous heats are obviously inferior, and since it is near impossible to get meaningful property measurements for them.

Table V compares the 0.2% yield strength, the ultimate tensile strength, the elongation and the hardness for austenitic heat J with duplex heat V. These properties are compared after hot rolling, after annealing at 1950°F for 7 minutes, and after cold reductions of 10, 25 and 50%.

TABLE V

| HEAT | STRUCTURE | CONDITION | PROPERTIES 0.2%YS (psi) | UTS (psi) | ELONGATION (%) | HARDNESS |
|---|---|---|---|---|---|---|
| J. | AUSTENITIC | HOT ROLLED | 177,300 | 190,200 | 23.8 | 46.0 Rc |
| V. | AUSTENITE & FERRITE | HOT ROLLED | 75,690 | 108,470 | 17.0 | 97.0 Rb |
| J. | AUSTENITIC | ANNEALED | 118,700 | 157,900 | 44.7 | 33.5 Rc |
| V. | AUSTENITE & FERRITE | ANNEALED | 84,680 | 109,810 | 19.0 | 97.0 Rb |
| J. | AUSTENITIC | 10% COLD REDUCTION | 140,300 | 177,800 | 29.3 | 41.7 Rc |
| V. | AUSTENITE & FERRITE | 10% COLD REDUCTION | 119,560 | 126,030 | 8.5 | 26.0 Rc |
| J. | AUSTENITIC | 25% COLD REDUCTION | 184,400 | 218,200 | 13.8 | 43.7 Rc |
| V. | AUSTENITE & FERRITE | 25% COLD REDUCTION | 138,500 | 144,390 | 5.0 | 30.5 Rc |
| J. | AUSTENITIC | 50% COLD REDUCTION | 231,700 | 269,300 | 7.0 | 48.7 Rc |
| V. | AUSTENITE & FERRITE | 50% COLD REDUCTION | 156,610 | 164,020 | 3.5 | 32.5 Rc |

From Table V, it is clear that austenitic heat J is superior to duplex heat V. Heat J had better properties than heat V after hot rolling, after annealing, and after cold rolling. Ferrite diminishes the steel's yield strength, ultimate tensile strength, elongation and hardness. In addition, it detrimentally affects the steel's corrosion resistance and promotes the formation of undersirable sigma phase.

The steel of this invention has utility in a wide range of applications. Included therein are high strength fasteners, motor/generator retaining rings, marine cable, and castings for pump housings.

It will be apparent to those skilled in the art that the novel principles of the invention disclosed herein in connection with specific examples thereof, will suggest various other modifications and applications of the same. It is accordingly desired that in construing the breadth of the appended claims they shall not be limited to the specific examples of the invention disclosed herein.

I claim:

1. A method for producing a substantially nonporous, austenitic stainless steel consisting essentially of, in weight percent, from 10 to 30% chromium, from 21 to 45% manganese, from 0.85 to 3% nitrogen, up to 1% carbon, up to 2% silicon, balance essentially iron and residuals; which comprises the steps of: preparing a melt containing from 10 to 30% chromium, from 15 to 45% manganese, up to 1% carbon up to 2% silicon and balance iron and residuals, alloying the melt at an ambient pressure of about one atmosphere, with nitrogen in an amount of from 0.85 to 3%; balancing the elements in accordance with the following equations:

$$\frac{30\,(\%C + \%N) + 0.5\,(\%Mn)}{\%Cr + 1.5\,(\%Si)} \geqq 1.5$$

$$\%Cr + 0.8\,(\%Mn) - 11.88\,(\%N - 0.1) - 28.25 \geqq 0$$

and solidifying the melt.

2. A method according to claim 1 adapted to produce a substantially nonporous, austenitic stainless steel having from 15 to 27% chromium.

3. A method according to claim 1 adapted to produce a substantially nonporous, austenitic stainless steel having from 21 to 30% manganese.

4. A method according to claim 1 adapted to produce a substantially nonporous austenitic stainless steel having from 1.05 to 1.5% nitrogen.

5. A method according to claim 1 adapted to produce a substantially nonporous, austenitic stainless steel having up to 0.15% carbon.

6. A method according to claim 1 adapted to produce a substantially nonporous, austenitic stainless steel having up to 1% silicon.

7. A method according to claim 1 adapted to produce a substantially nonporous, austenitic stainless steel having from 15 to 27% chromium, from 21 to 30% manganese, from 1.05 to 1.5% nitrogen, up to 0.15% carbon and up to 1% silicon.

8. A method according to claim 1 adapted to produce a substantially nonporous, austenitic stainless steel having at least 21% manganese.

9. A method according to claim 1 adapted to produce a substantially nonporous, austenitic stainless steel having at least 15% chromium.

* * * * *